US005863847A

United States Patent [19]

De Voe et al.

[11] Patent Number: 5,863,847

[45] Date of Patent: Jan. 26, 1999

[54] SURFACE TREATED BACKINGS FOR COATED ABRASIVE ARTICLES

[75] Inventors: Robert J. De Voe, Oakdale; Gregg D. Dahlke, St. Paul, both of Minn.; Kimberly K. Harmon, Hudson, Wis.; Craig A. Masmar, Lake Elmo, Minn.

[73] Assignee: Minnesota Mining and Manufacturing Company, St. Paul, Minn.

[21] Appl. No.: 46,379

[22] Filed: Mar. 23, 1998

Related U.S. Application Data

[62] Division of Ser. No. 710,596, Sep. 20, 1996, Pat. No. 5,766,277.

[51] Int. Cl.[6] ..... C08J 7/04

[52] U.S. Cl. ..... 442/151; 442/150; 522/170; 525/533; 427/513; 427/516; 427/521; 427/386; 427/389.9

[58] Field of Search ..... 442/150, 151; 522/170; 525/533; 427/513, 516, 521, 386, 389.9

[56] References Cited

U.S. PATENT DOCUMENTS

| | | | |
|---|---|---|---|
| 3,018,262 | 1/1962 | Schroeder . | |
| 3,117,099 | 1/1964 | Douros, Jr. et al. . | |
| 4,047,903 | 9/1977 | Hesse et al. | 51/298 |
| 4,547,204 | 10/1985 | Caul | 51/298 |
| 4,609,581 | 9/1986 | Ott . | |
| 4,652,275 | 3/1987 | Bloecher et al. . | |
| 4,735,632 | 4/1988 | Oxman et al. . | |
| 4,751,138 | 6/1988 | Tumey et al. | 428/323 |
| 4,799,939 | 1/1989 | Bloecher et al. . | |
| 4,916,021 | 4/1990 | Karle et al. | 428/425.9 |
| 4,985,340 | 1/1991 | Palazzotto et al. . | |
| 4,997,717 | 3/1991 | Rembold et al. | 428/413 |
| 5,108,463 | 4/1992 | Buchanan . | |
| 5,137,452 | 8/1992 | Pollock . | |
| 5,252,694 | 10/1993 | Willett et al. . | |
| 5,254,194 | 10/1993 | Ott et al. . | |
| 5,256,170 | 10/1993 | Harmer et al. | 51/293 |
| 5,417,726 | 5/1995 | Stout et al. . | |
| 5,436,063 | 7/1995 | Follett et al. | 428/224 |
| 5,476,748 | 12/1995 | Steinmann et al. | 430/269 |
| 5,505,747 | 4/1996 | Chesley et al. | 51/297 |
| 5,520,957 | 5/1996 | Bange et al. . | |
| 5,565,011 | 10/1996 | Follett et al. | 51/297 |
| 5,582,672 | 12/1996 | Follett et al. | 156/279 |

FOREIGN PATENT DOCUMENTS

| | | |
|---|---|---|
| 306 161 | 3/1989 | European Pat. Off. . |
| 0 552 698 | 7/1993 | European Pat. Off. . |
| 486 308 | 7/1995 | European Pat. Off. . |
| 306 162 | 10/1995 | European Pat. Off. . |
| 2 701 417 A | 8/1994 | France . |
| 30 06 458 A | 9/1981 | Germany . |
| 32 07 293 | 11/1982 | Germany . |
| 2 087 263 | 5/1982 | United Kingdom . |
| WO 93/12911 | 7/1993 | WIPO . |
| WO 94 043818 A | 3/1994 | WIPO . |
| WO 95/11111 | 4/1995 | WIPO . |

OTHER PUBLICATIONS

Assistant Professor Dr. Swaraji Paul (royal Institute of Technology, Sweden): "Surface Coatings", 1986, John Wiley & sons, Chichester, U.K. XP002031346 (pp. 611–640).

*Primary Examiner*—Christopher Raimund
*Attorney, Agent, or Firm*—Gregory J. Feulner

[57] ABSTRACT

A coated article comprising a backing and a binder is disclosed. The binder precursor is an energy-curable melt-processable resin containing an epoxy resin, a polyester component, a polyfunctional acrylate component, and a curing agent for crosslinking the epoxy resin. The binder precursor is cured to provide a crosslinked coating. The invention also relates to a method of producing such coated articles and a surface-treated porous cloth material.

21 Claims, 2 Drawing Sheets

SURFACE TREATED BACKINGS FOR COATED ABRASIVE ARTICLES

This is a division of application Ser. No. 08/710,596 filed Sep. 20, 1996, now U.S. Pat. No. 5,766,277.

BACKGROUND OF THE INVENTION

1. Field of the Invention

This invention relates to coated abrasive articles and a method of making the coated abrasive articles, and, more particularly, to such articles which incorporate an energy curable melt processable binder as the make coat.

2. Description of the Related Art

Coated abrasives generally comprise a flexible backing upon which a binder supports a coating of abrasive particles. The abrasive particles are typically secured to the backing by a first binder, commonly referred to as a make coat. Additionally, the abrasive particles are generally oriented with their longest dimension perpendicular to the backing to provide an optimum cut rate. A second binder, commonly referred to as a size coat, is then applied over the make coat and the abrasive particles to anchor the particles to the backing.

Porous cloth, fabric and textile materials are frequently used as backings for coated abrasive articles. The make coat precursor is typically applied to the backing as a low viscosity material. In this condition, the make coat precursor can infiltrate into the interstices of the porous backing leaving an insufficient coating thickness making it difficult to bond the subsequently applied abrasive particles to the backing and, on curing, resulting in the backing becoming stiff, hard and brittle. As a result, it has become conventional to employ one or more treatment coats, such as a presize, saturant coat, backsize or a subsize coat, to seal the porous backing.

The presize, saturant coat, backsize and subsize coat typically involve thermally curable resinous adhesives, such as phenolic resins, epoxy resins, acrylate resins, acrylic lattices, lattices, urethane resins, glue, starch and combinations thereof. A saturant coat saturates the cloth and fills pores, resulting in a less porous, stiffer cloth with more body. An increase in body provides an increase in strength and durability of the article. A presize coat, which is applied to the front side of the backing, may add bulk to the cloth or may improve adhesion of subsequent coatings. A backsize coat, which is applied to the back side of the backing, i.e., the side opposite that to which the abrasive grains are applied, adds body to the backing and protects the yarns of the cloth from wear. A subsize coat is similar to a saturation coat except that it is applied to a previously treated backing. The drawback of such a presize, saturant coat, backsize and subsize coat is that it entails added processing step(s) which increase the cost and complexity of manufacturing. Similarly, paper backings may be treated to prevent penetration of make adhesives and/or to waterproof.

U.S. Pat. No. 5,436,063 (Follett et al.) describes a coated abrasive article incorporating a make coat which can be readily applied to a porous backing that successfully eliminates the need for a separate presize or saturant coat to seal the backing. The coated abrasive article described in U.S. Pat. No. 5,436,063 generally involves a backing bearing a crosslinked first binder (i.e., a make coat) on the backing, where the first binder consists of an epoxy resin, a polyester component, and a photocatalyst for crosslinking the binder.

U.S. Pat. No. 4,047,903 (Hesse et al.) describes a process for manufacturing coated abrasives and the water resistant coated abrasive products thereof in which the make and size binders are cured by radiation energy. At least one of the make and size binders is a reaction product of either (i) a polycarboxylic acid with an esterified epoxy resin prepared by reacting an epoxy resin with an acrylic acid or methacrylic acid, or mixtures thereof, or (ii) the reaction product of the above-mentioned esterified epoxy resin which is first reacted with diketenes and then reacted with a chelate forming compound.

U.S. Pat. No. 4,547,204 (Caul) describes a coated abrasive in which at least one of the back, base, make, and size layers is an electron beam curable epoxy acrylate or urethane acrylate resin and another layer of which is a thermally curable resin such as a phenolic or an acrylic latex resin. The electron beam curable resin formulation as described can include an epoxy acrylate or urethane acrylate oligomer, a diluent such as vinyl pyrrolidone or multi- or monofunctional acrylates, and a filler with minor amounts of other additives such as surfactants, pigments and suspending agents.

U.S. Pat. No. 4,751,138 (Tumey et al.) describes a radiation curable binder system for coated abrasives where at least one of a saturant, presize, backsize, make, and size coating is formed from a composition curable by electromagnetic radiation involving a photoinitiator portion, and a curable portion containing both ethylenically unsaturated groups and 1,2-epoxide groups, which groups can be supplied by the same or different compounds. The epoxies cure via cationic polymerization and the acrylates cure via free radical polymerization.

U.S. Pat. No. 4,997,717(Rembold et al.) describes a process of making a coated abrasive and products thereof which involves applying a binder layer to a backing, briefly irradiating the binder layer with actinic light, applying the abrasive particles to the still tacky binder layer before or after irradiation and effecting subsequent or simultaneous heat curing. The binder layer is an epoxy resin used in conjunction with at least one cationic photoinitiator. Additionally a size coat can be utilized.

U.S. Pat. No. 5,256,170 (Harmer et al.) describes a method of making a coated abrasive article where the plurality of abrasive grains are applied to a make coat. The make coat precursor contains at least one ethylenically unsaturated monomer, at least one cationically polymerizable monomer, such as an epoxy monomer, or polyurethane precursor, and an effective amount of a catalyst. The make coat precursor becomes a pressure-sensitive adhesive when partially or fully cured with sufficient tack to hold the abrasive grains during subsequent application and curing of a size coat.

WO 95/11111 (Follett et al.) describes an abrasive article and method for its manufacture in which a make coat layer precursor is laminated onto the front surface of an atypical backing material, such as an open weave cloth, knitted fabric, porous cloth, untreated paper, open or closed cell foams, and nonwovens, to seal the backing surface. A plurality of abrasive particles are adhered to the make coat.

However, a need remains for a multifunctional make coat which not only can seal a porous backing, but which additionally affords enhanced Theological properties to control the amount of resin flow during curing and to reduce the sensitivity to make resin coating thickness, particularly when coating fine mineral grades.

SUMMARY OF THE INVENTION

This invention generally relates to a coated abrasive article utilizing an improved make coat formulation. The coated abrasive article includes a backing, the improved make coat on the backing, and a plurality of abrasive particles at least partially embedded in the make coat. The make coat also may be referred to herein as the first binder.

The improved make coat formulation used in the inventive coated abrasive article involves use of a polyfunctional acrylate component to modify a binder system containing an epoxy resin and a polyester component. The term polyfunctional acrylate component is also meant to include monomers and oligomers. The polyfunctional acrylate oligomers may be derived from polyethers, polyesters, and the like. The polyfunctional acrylate monomers are the preferred type of polyfunctional acrylate binder modifier.

The presence of the polyfunctional acrylate modifier in conjunction with an epoxy resin/polyester binder system has been discovered to favorably assist in rheology control which, in turn, translates into significant processing advantages and improved product performance.

Moreover, the preferred improved make coat formulation, as modified with the polyfunctional acrylate component, is a pressure sensitive hot melt formulation that can be energy cured to provide a crosslinked coating. As a hot melt, the make coat formulation remains well-suited for sealing porous cloth, textile or fabric backings while preserving the intrinsic flexibility and pliability of the backing.

The polyfunctional acrylate-modified epoxy/polyester systems provide superior rheology control beyond that which is afforded with hot melt epoxy/polyester component systems lacking the polyfunctional acrylate binder modifier. More specifically, the hot melt make coat formulations used in the present invention have a lower melt viscosity prior to irradiation and a higher viscosity subsequent to irradiation than the mere combinations of epoxy and polyester component devoid of the polyfunctional acrylate component. As a result, performance of abrasive articles containing these hot melt materials of the present invention are less sensitive to coating thickness than typical photocurable hot melt resin systems. Moreover, these processing advantages are realized without compromising the desirable thermomechanical properties of the epoxy/polyester component systems.

Additionally, the make coat formulations of this invention can be coated and cured more easily and more consistently, providing a coated abrasive article with superior performance over a wider range of processing conditions, than some prior hot melts based on curable mixtures of polyester and epoxy resin components alone.

In more preferred make coat formulations, the effective concentration range of the polyfunctional acrylate is proportional to the equivalent weight of the polyfunctional acrylate and it is inversely proportional to functionality. It is within the scope of this invention to blend a monofunctional acrylate resin with the polyfunctional acrylate component of the invention. As to the polyester component of the make coat, it preferably is a thermoplastic polyester which imparts pressure sensitive properties to the hot melt make coat formulation.

In a preferred embodiment, said make coat is formed by curing a binder precursor composition containing, per 100 parts by weight of the binder precursor composition: (a) about 5 to 75 parts by weight of the epoxy resin; (b) about 94 to 5 parts by weight of the polyester component; (c) about 0.1 to 20 parts by weight of the polyfunctional acrylate component; (d) about 0.1 to 4 parts by weight epoxy photocatalyst; (e) about 0 to 4 parts by weight epoxy accelerator; and (f) about 0 to 5 parts by weight free radical photoinitiator.

An optional hydroxyl-containing material having a hydroxyl functionality greater than 1 may also be included in the make coat formulation to decrease both the rate of curing, if desired, and/or stiffness of the make coat.

In a further embodiment of the present invention, a size coat, i.e., a second binder, can be applied upon the make coat and abrasive particles to reinforce the attachment of the abrasive particles to the backing. A supersize coat, i.e., a third binder, over the size coat, also may be used.

The make coat precursor may be in a solid form prior to coating and can be coated as a hot melt. Alternatively, the make coat precursor may be a solid film that is transfer coated to the backing. Thus the invention covers different embodiments to apply the make coat precursor to the backing.

The invention also relates to a method of providing such coated abrasive articles. The energy curable, hot melt pressure sensitive first binder is applied (preferably by coating) to the backing and is exposed to energy (preferably actinic radiation). A plurality of abrasive particles is deposited in the first binder either before it is exposed to energy, or after it is exposed to energy but not fully cured. The binder is then permitted to fully cure to a crosslinked coating. The pressure sensitive properties of the first binder (before it is final cured) permits the abrasive particles to adhere thereto. The first binder can preferably be thermally postcured.

The invention additionally relates to use of the energy curable, hot melt pressure sensitive first binder as a backing treatment coating for porous cloth materials to function, for example, as a saturant coat, a presize coat, a backsize coat, or as a subsize coat, to protect the cloth fibers and/or to seal the porous cloth material. If liquefied, the binder can be coated as a size coat.

BRIEF DESCRIPTION OF THE DRAWINGS

The invention will be more fully understood with reference to the following drawings in which similar reference numerals designate like or analogous components throughout and in which.

DETAILED DESCRIPTION OF THE PREFERRED EMBODIMENTS

Figure 1:
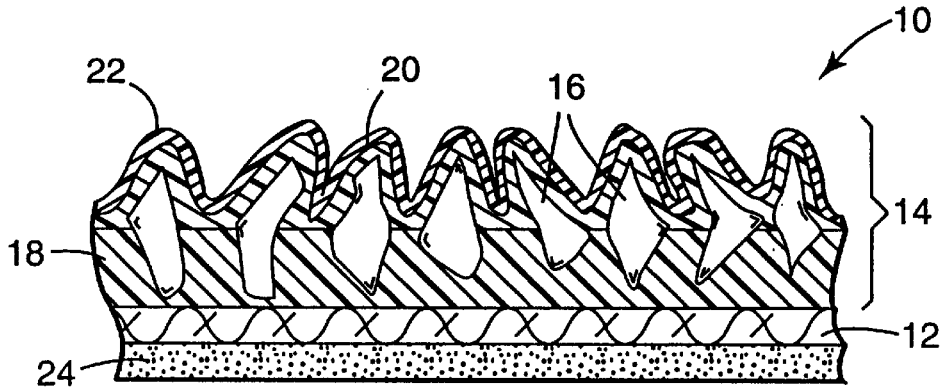
FIG. 1 is an enlarged sectional view of a segment of a coated abrasive article according to an embodiment of the invention.

Turning now to the drawings, FIG. 1 illustrates a coated abrasive article 10 according to the invention comprising a backing 12 and an abrasive layer 14 bonded thereto.

Backing 12 may be a conventional, sealed coated abrasive backing or a porous, non-sealed backing. Backing 12 may be comprised of cloth, vulcanized fiber, paper, nonwoven materials, fibrous reinforced thermoplastic backing, polymeric films, substrates containing hooked stems, looped fabrics, metal foils, mesh, foam backings, and laminated multilayer combinations thereof Cloth backings can be untreated, saturated, pre-sized, backsized, porous, or sealed, and they may be woven or stitch bonded. The cloth backings may include fibers or yarns of cotton, polyester, rayon, silk, nylon or blends thereof. The cloth backings can be provided as laminates with different backing materials described herein. Paper backings also can be saturated, barrier coated, pre-sized, backsized, untreated, or fiber-reinforced. The paper backings also can be provided as laminates with a different type of backing material. Nonwoven backings include scrims and laminates to different backing materials mentioned herein. The nonwovens may be formed of cellulosic fibers, synthetic fibers or blends thereof Polymeric backings include polyolefin or polyester films. The polymeric backings can be provided as blown film, or as laminates of different types of polymeric materials, or laminates of polymeric films with a non-polymeric type of backing material. The backing can also be a stem web used alone or incorporating a nonwoven, or as a laminate with a different type of backing. The loop fabric backing can be brushed nylon, brushed polyester, polyester stitched loop, and loop material laminated to a different type of backing material. The foam backing may be a natural sponge material or polyurethane foam and the like. The foam backing also can be laminated to a different type of backing material. The mesh backings can be made of polymeric or metal open-weave scrims. Additionally, the backing may be a spliceless belt such as that disclosed in PCT WO 93/12911 (Benedict et al.), or a reinforced thermoplastic backing that is disclosed in U.S. Pat. No. 5,417,726 (Stout et al.).

Abrasive layer 14 comprises a multiplicity of abrasive particles 16 which are bonded to a major surface of backing 12 by a first binder or make coat 18. A second binder or size coat 20 is applied over the abrasive particles and the make coat to reinforce the particles. The abrasive particles typically have a size of about 0.1 to 1500 microns ($\mu$m), more preferably from about 1 to 1300 $\mu$m. Examples of useful abrasive particles include fused aluminum oxide based materials such as aluminum oxide, ceramic aluminum oxide (which may include one or more metal oxide modifiers and/or seeding or nucleating agents), and heat treated aluminum oxide, silicon carbide, co-fused alumina-zirconia, diamond, ceria, titanium diboride, cubic boron nitride, boron carbide, garnet and blends thereof Abrasive particles also include abrasive agglomerates such as disclosed in U.S. Pat. No. 4,652,275 and U.S. Pat. No. 4,799,939, which patents are hereby incorporated by reference.

The first binder is formed from a first binder precursor. The term "precursor" means the binder is uncured and not crosslinked. The term "crosslinked" means a material having polymeric sections that are interconnected through chemical bonds (i.e., interchain links) to form a three-dimensional molecular network. Thus, the first binder precursor is in an uncured state when applied to the backing. In general, the first binder comprises a cured or crosslinked thermosetting polymer. For purposes of this application, "cured" and "polymerized" can be used interchangeably. However, with the appropriate processing conditions and optional catalysts, the first binder precursor is capable of crosslinking to form a thermosetting binder. For purposes of this invention, the first binder precursor is "energy-curable" in the sense that it can crosslink (i.e., cures) upon exposure to radiation, e.g., actinic radiation, electron beam radiation, and/or thermal radiation. Additionally, under the appropriate processing conditions, the first binder precursor is a hot melt pressure sensitive adhesive. For example, depending upon the chemistry, at room temperature the first binder precursor may be a solid. For instance, the first binder precursor may be a solid film that is transfer coated to the backing. Upon heating to elevated temperature, this first binder precursor is capable of flowing, increasing the tack of the hot melt pressure sensitive adhesive. Alternatively, for instance, if the resin is solvent-borne, the first binder precursor may be liquid at room temperature.

In one embodiment of the invention, first binders useful in the make coat formulations of the coated abrasive articles of the invention preferably include a hot melt pressure sensitive adhesive composition that cures upon exposure to energy to provide a covalently crosslinked, thermoset make coat. Because the make coat can be applied as a hot melt composition, with the appropriate processing conditions, the make coat does not readily penetrate the backing so as to compromise the backing's inherent pliability and flexibility. Consequently, the make coats disclosed herein are particularly advantageous when employed in conjunction with porous cloth, fabric or textile backings. However, the make coat precursor will penetrate into the backing to some degree to provide good adhesion to the backing. This degree of penetration will depend in part on the particular chemistry and processing conditions, and can be controlled.

The term "porous" as used herein in connection with backings, means a backing not having an abrasive layer, a make coat, an adhesive layer, a sealant, a saturant coat, a presize coat, a backsize coat, and so forth thereon, and which demonstrates a Gurley porosity of less than 50 seconds when measured according to Federal Test Method Std. No. 191, Method 5452 (published Dec. 31, 1968) (as referred to in the *Wellington Sears Handbook of Industrial Textiles* by E. R. Kaswell, 1963 edition, page 575) using a Gurley Permeometer (available from Teledyne Gurley, Inc., Troy, N.Y.). Cloth backings of presently known coated abrasive articles conventionally require special treatments such as a saturant coat, a presize coat, a backsize coat or a subsize coat to protect the cloth fibers and to seal the backing. The backing may be free of these treatments. Alternatively, the backing may comprise one or more of these treatments. The type of backing and backing treatment depends in part on the desired properties for the intended use. The hot melt make coats of the invention can provide such treatments.

The pressure sensitive adhesive qualities of the hot melt make coat enable the abrasive particles to adhere to the make coat until the make coat is cured. The crosslinked, thermoset make coat is tough, yet flexible, and aggressively adheres to the backing.

As used herein, a "hot melt" refers to a composition that is a solid at room temperature (about 20° to 22° C.) but which, upon heating, melts to a viscous liquid that can be readily applied to a coated abrasive article backing. A "melt processable" composition refers to a composition that can transform, for example, by heat and/or pressure, from a solid to a viscous liquid by melting, at which point it can be readily applied to a coated abrasive article backing. Desirably, the hot melt make coats of the invention can be formulated as solvent free systems (i.e., they have less than 1% solvent in the solid state). However if so desired, it may be feasible to incorporate solvent or other volatiles into the binder precursor. As used herein, a "pressure sensitive adhesive" refers to a hot melt composition that, at the time abrasive particles are applied thereto, displays pressure sensitive adhesive properties. "Pressure sensitive adhesive properties" means that the composition is tacky immediately after application to a backing and while still warm and, in some cases, even after it has cooled to room temperature.

The hot melt make coats useful in the invention include, and more preferably consist essentially of, an epoxy resin that contributes to the toughness and durability of the make coat, a thermoplastic polyester component that allows for the make coat to display pressure sensitive adhesive properties, a polyfunctional acrylate component to modify the rheological properties of the make coat and reduce the make coat's sensitivity to process variables, and a curative for the epoxy portion of the make coat formulation and an optional initiator for the polyfunctional acrylate portion of the formulation that permits the composition to cure upon exposure to energy. Optionally, the hot melt make coats of the invention may also include a hydroxyl-containing material to modify the rate of curing and/or stiffness of the make coats, a tackifier, a filler, and the like.

Epoxy resins useful in the make coats of the invention are any organic compounds having at least one oxirane ring, i.e.,

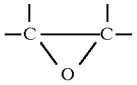

polymerizable by a ring opening reaction. Such materials, broadly called epoxides, include both monomeric and polymeric epoxides and can be aliphatic, cycloaliphatic, or aromatic. They can be liquid or solid or blends thereof, blends being useful in providing tacky adhesive films. These materials generally have, on the average, at least two epoxy groups per molecule (preferably more than two epoxy groups per molecule). The polymeric epoxides include linear polymers having terminal epoxy groups (e.g., a diglycidyl ether of a polyoxyalkylene glycol), polymers having skeletal oxirane units (e.g., polybutadiene polyepoxide), and polymers having pendent epoxy groups (e.g., a glycidyl methacrylate polymer or copolymer). The molecular weight of the epoxy resin may vary from about 74 to about 100,000 or more. Mixtures of various epoxy resins can also be used in the hot melt compositions of the invention. The "average" number of epoxy groups per molecule is defined as the number of epoxy groups in the epoxy resin divided by the total number of epoxy molecules present.

Useful epoxy resins include those which contain cyclohexene oxide groups such as the epoxycyclohexanecarboxylates, typified by 3,4-epoxycyclohexylmethyl-3,4-epoxycyclohexane carboxylate, 3,4-epoxy-2-methylcyclohexylmethyl-3,4-epoxy-2-methycyclohexane carboxylate, and bis(3,4-epoxy-6-methylcyclohexylmethyl)adipate. For a more detailed list of useful epoxides of this nature, reference may be made to U.S. Pat. No. 3,117,099, incorporated herein by reference.

Further epoxy resins which are particularly useful in the practice of this invention include glycidyl ether monomers of the formula

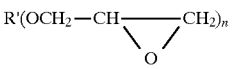

where R' is alkyl or aryl and n is an integer of 1 to 6. Examples are the glycidyl ethers of polyhydric phenols obtained by reacting a polyhydric phenol with an excess of chlorohydrin such as epichlorohydrin, e.g., the diglycidyl ether of 2,2-bis-2,3-epoxypropoxyphenol propane. Further examples of epoxides of this type which can be used in the practice of this invention are described in U.S. Pat. No. 3,018,262, incorporated herein by reference.

There is a host of commercially available epoxy resins which can be used in this invention. In particular, epoxides which are readily available include octadecylene oxide, epichlorohydrin, styrene oxide, vinyl cyclohexene oxide, glycidol, glycidyl-methacrylate, diglycidyl ether of Bisphenol A (e.g., those available under the trade designations "EPON 828," "EPON 1004," and "EPON 1001F" from Shell Chemical Co., and "DER-332" and "DER-334," from Dow Chemical Co.), diglycidyl ether of Bisphenol F (e.g., "ARALDITE GY281" from Ciba-Geigy), vinylcyclohexene dioxide (e.g., having the trade designation "ERL 4206" from Union Carbide Corp.), 3,4-epoxycyclohexyl-methyl-3,4-epoxycyclohexene carboxylate (e.g., having the trade designation "ERL-4221" from Union Carbide Corp.), 2-(3,4-epoxycyclo-hexyl-5,5-spiro-3,4-epoxy) cyclohexane-metadioxane (e.g., having the trade designation "ERL-4234" from Union Carbide Corp.), bis(3,4-epoxy-cyclohexyl) adipate (e.g., having the trade designation "ERL-4299" from Union Carbide Corp.), dipentene dioxide (e.g., having the trade designation "ERL-4269" from Union Carbide Corp.), epoxidized polybutadiene (e.g., having the trade designation "OXIRON 2001" from FMC Corp.), silicone resin containing epoxy functionality, epoxy silanes, e.g., beta-3,4-epoxycyclohexylethyltri-methoxy silane and gamma-glycidoxypropyltrimethoxy silane, commercially available from Union Carbide, flame retardant epoxy resins (e.g., having the trade designation "DER-542," a brominated bisphenol type epoxy resin available from Dow Chemical Co.), 1,4-butanediol diglycidyl ether (e.g., having the trade designation "ARALDITE RD-2" from Ciba-Geigy), hydrogenated bisphenol A-epichlorohydrin based epoxy resins (e.g. having the trade designation "EPONEX 1510" from Shell Chemical Co.), and polyglycidyl ether of phenol-formaldehyde novolak (e.g., having the trade designation "DEN-431" and "DEN-438" from Dow Chemical Co.).

It is also within the scope of this invention to use a compound that has both epoxy and acrylate functionality, for example, as described in U.S. Pat. No. 4,751,138 (Tumey et al.), which is incorporated herein by reference. In this instance, a separate polyfunctional acrylate component is required if the compound having both epoxy and acrylate functionality is monofunctional in acrylate.

Thermoplastic polyesters are preferred as the polyester component of the make coat formulation. Useful polyester components include both hydroxyl and carboxyl terminated materials, which may be amorphous or semicrystalline, of which the hydroxyl terminated materials are more preferred. By "amorphous" is meant a material that displays a glass transition temperature but does not display a measurable crystalline melting point by differential scanning calorimetry (DSC). Preferably the glass transition temperature is less than the decomposition temperature of the initiator (discussed below), but without being more than about 120° C. By "semicrystalline" is meant a polyester component that displays a crystalline melting point by DSC, preferably with a maximum melting point of about 150° C.

The viscosity of the polyester component is important in providing a hot melt make coat (as opposed to a make coat which is a liquid having a measurable viscosity at room temperature). Accordingly, polyester components useful in the make coats of the invention preferably have a Brookfield viscosity which exceeds 10,000 milliPascals at 121° C. as measured on a Brookfield Viscometer Model # DV-II employing spindle #27 with a thermocel attachment. Viscosity is related to the molecular weight of the polyester component. Preferred polyester components also have a number average molecular weight of about 7500 to 200,000, more preferably from about 10,000 to 50,000 and most preferably from about 20,000 to 40,000.

Polyester components useful in the make coats of the invention comprise the reaction product of dicarboxylic acids (or their diester derivatives) and diols. The diacids (or their diester derivatives) can be saturated aliphatic acids containing from 4 to 12 carbon atoms (including unbranched, branched, or cyclic materials having 5 to 6 atoms in a ring) and/or aromatic acids containing from 8 to 15 carbon atoms. Examples of suitable aliphatic acids are succinic, glutaric, adipic, pimelic, suberic, azelaic, sebacic, 1,12 dodecanedioic, 1,4-cyclo-hexanedicarboxylic, 1,3-cyclopentane-dicarboxylic, 2-methylsuccinic, 2-methylpentanedioic, 3-methylhexanedioic acids and the like. Suitable aromatic acids include terephthalic acid, isophthalic acid, phthalic acid, 4,4'-benzophenone dicarboxylic acid, 4,4'-diphenylmethanedicarboxylic acid, 4,4'-diphenylether dicarboxylic acid, 4,4'-diphenylthio-ether dicarboxylic acid and 4,4'-diphenylamine dicarboxylic acid. Preferably the structure between the two carboxyl groups in these diacids contains only carbon and hydrogen; more preferably it is a phenylene group. Blends of any of the foregoing diacids may be used.

The diols include branched, unbranched, and cyclic aliphatic diols having from 2 to 12 carbon atoms, such as, for example, ethylene glycol, 1,3-propylene glycol, 1,2-propylene glycol, 1,4-butanediol, 1,3-butanediol, 1,5-pentanediol, 2-methyl-2,4-pentanediol, 1,6-hexanediol, 1,8-octanediol, cyclobutane-1,3-di(2'ethanol), cyclohexane-1,4-dimethanol, 1,10-decanediol, 1,12-dodecanediol, and neopentyl glycol. Long chain diols including poly (oxyalkylene) glycols in which the alkylene group contains from 2 to 9 carbon atoms (preferably 2 to 4 carbon atoms) may also be used. Blends of any of the foregoing diols may be used.

Useful, commercially available hydroxyl terminated polyester materials include various saturated, linear, semi-crystalline copolyesters available from Hüls America, Inc., under the trade designations including "DYNAPOL S1402," "DYNAPOL S1358," "DYNAPOL S1227," "DYNAPOL S1229" and "DYNAPOL S1401". Useful saturated, linear amorphous copolyesters available from Hüls America, Inc. include materials under the trade designations "DYNAPOL S1313" and "DYNAPOL S1430".

A "polyfunctional acrylate" component of the inventive hot melt make coat formulations means ester compounds which are the reaction product of aliphatic polyhydroxy compounds and (meth)acrylic acids. The aliphatic polyhydroxy compounds include compounds such as (poly) alkylene glycols and (poly)glycerols.

(Meth)acrylic acids are unsaturated carboxylic acids which include, for example, those represented by the following basic formula:

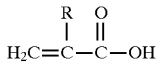

where R is a hydrogen atom or a methyl group.

Polyfunctional acrylates can be a monomer or an oligomer. For purposes of this invention, the term "monomer" means a small (low-molecular-weight) molecule with an inherent capability of forming chemical bonds with the same or other monomers in such manner that long chains (polymeric chains or macromolecules) are formed. For this application, the term "oligomer" means a polymer molecule having 2 to 10 repeating units (e.g., dimer, trimer, tetramer, and so forth) having an inherent capability of forming chemical bonds with the same or other oligomers in such manner that longer polymeric chains can be formed therefrom. Mixtures of monomers and oligomers also could be used as the polyfunctional acrylate component. It is preferred that the polyfunctional acrylate component be monomeric.

Representative polyfunctional acrylate monomers include, by way of example and not limitation: ethylene glycol diacrylate, ethylene glycol dimethacrylate, hexanediol diacrylate, triethylene glycol diacrylate, trimethylolpropane triacrylate, ethoxylated trimethylolpropane triacrylate, glycerol triacrylate, pentaerthyitol triacrylate, pentaerythritol trimethacrylate, pentaerythritol tetraacrylate, pentaerythritol tetramethacrylate, and neopentylglycol diacrylate. Mixtures and combinations of different types of such polyfunctional acrylates also can be used. The term "acrylate", as used herein, encompasses acrylates and methacrylates.

Useful commercially available polyfunctional acrylates include a trimethylolpropane triacrylate having the trade designation "SR351," an ethoxylated trimethylolpropane triacrylate having the trade designation "SR454," a pentaerythritol tetraacrylate having the trade designation "SR295," and a neopentylglycol diacrylate having the trade designation "SR247," and all of these being commercially available from Sartomer Co., Exton, Pa.

The polyfunctional acrylate monomers cure quickly into a network due to the multiple functionalities available on each monomer. If there is only one acrylate functionality, a linear, non-networked molecule will result upon cure of the material. Polyfunctional acrylates having a functionality of two or more are preferred in this invention to encourage and promote the desired polymeric network formation.

Useful polyfunctional acrylate oligomers include commercially available polyether oligomers such as polyethylene glycol 200 diacrylate having the trade designation "SR259" and polyethylene glycol 400 diacrylate having the trade designation "SR344," both being commercially available from Sartomer Co., Exton, Pa.

Other oligomers include acrylated epoxies such as diacrylated esters of epoxy resins, e.g., diacrylated esters of bisphenol A epoxy resin. Examples of commercially available acrylated epoxies include epoxies available under the trade designations "CMD 3500," "CMD 3600," and "CMD 3700," from Radcure Specialties.

For example, make coat formulations containing positive amounts of trimethylolpropane triacrylate (TMPTA) in a fraction less than 10%, by weight, as blended in a photocurable hot melt formulation comprised of about 60% by weight epoxy (the remainder including polyester and tackifier), are lower in viscosity at coating temperatures (90°–100° C.) than the unmodified formulation (i.e., devoid of polyfunctional acrylate) and, as a result, are noticeably easier to coat. These make coat formulations also provide improved tack at room temperature (i.e., tack increases with increasing proportion of TMPTA).

In general, the optimal amount of the polyfunctional acrylate used in the make coat formulation is proportional to the acrylate equivalent weight and inversely proportional to the acrylate functionality.

Make coat compositions based on epoxy and polyester which also contain the polyfunctional acrylates are also higher in viscosity after exposure to UV radiation. This feature allows for a fine-tuning of the relative rates of epoxy cure and resin flow allowing for control of the degree of abrasive particle wetting and orientation. As general formulation guidelines, with too little polyfunctional acrylate, the resin can flow too readily wetting the abrasive particles so well that the abrasive particles are buried below the surface of the coating, particularly with thicker coatings. With too much polyfunctional acrylate, the resin cannot flow sufficiently to wet the abrasive particles before the epoxy component is fully cured. In this case, even though the uncured make coat resin is aggressively tacky at room temperature, abrasive particle adhesion is poor because wetting is precluded by the rheology of the post-irradiated resin. On the other hand, increasing amounts of the epoxy resin relative to the polyester component and polyfunctional acrylate component tends to result in stiffer make coats. Thus, the relative amounts of these three ingredients are balanced depending on the properties sought in the final make coat.

A preferred make coat formulation of this invention contains, per 100 parts by weight: (a) about 5 to 75 parts by weight of the epoxy resin; (b) about 5 to 94 parts by weight of the polyester component; (c) about 0.1 to 20 parts by weight of the polyfunctional acrylate component; (d) about 0.1 to 4 parts by weight epoxy photocatalyst; (e) about 0 to 4 parts by weight epoxy accelerator; and (f) about 0 to 5 parts by weight free radical photoinitiator. A more preferred make coat formulation includes (a) about 40 to 75 parts by weight of the epoxy resin; (b) about 10 to 55 parts by weight of the polyester component; (c) about 0.1 to 15 parts by weight of the polyfunctional acrylate; (d) about 0.1 to 3 parts by weight epoxy photocatalyst; (e) about 0.1 to 3 parts by weight epoxy accelerator; and (f) about 0.1 to 3 parts by weight free radical photoinitiator.

The improved make coating may also comprise additives such as a surfactant, a wetting agent, an anti-foaming agent, a filler, a plasticizer, a tackifier or mixtures and combinations thereof.

The make coat formulation may be cured by including curatives which promote crosslinking of the make coat precursor. The curatives may be activated by exposure to electromagnetic radiation (e.g., light having a wavelength in the ultraviolet or visible regions of the electromagnetic spectrum), by accelerated particles (e.g., electron beam radiation), or thermally (e.g., heat or infrared radiation). Preferably, the curatives are photoactive; that is, they are photocuratives activated by actinic radiation (radiation having a wavelength in the ultraviolet or visible portion of the electromagnetic spectrum).

An important aspect of the nature of the cure of the make coat formulation resides in that the polyfunctional acrylate component thereof can polymerize via a free radical mechanism while the epoxy portion of the formulation can polymerize via a cationic mechanism. In most instances, when a photocurative is exposed to ultraviolet or visible light, it generates a free radical or a cation, depending on the type of photocurative. Then, the free radical initiates or cation catalyzes the polymerization of the resinous adhesive.

In the case of the free radical curable polyfunctional acrylate component, it is useful to add a free radical initiator to the make coat precursor, although it should be understood that an electron beam source also could be used to initiate and generate free radicals. The free radical initiator preferably is added in an amount of 0.1 to 3.0% by weight, based on the total amount of resinous components. Examples of useful photoinitiators, that generate a free radical source when exposed to ultraviolet light, include, but are not limited to, organic peroxides, azo compounds, quinones, benzophenones, nitroso compounds, acyl halides, hydrazones, mercapto compounds, pyrylium compounds, triacylimidazoles, acylphosphine oxides, bisimidazoles, chloroalkyltriazines, benzoin ethers, benzil ketals, thioxanthones, and acetophenone derivatives, and mixtures thereof. Examples of photoinitiators that generate a source of free radicals when exposed to visible radiation, are described in U.S. Pat. No. 4,735,632, which description is incorporated herein by reference. A preferred free radical-generating initiator for use with ultraviolet light is an initiator commercially available from Ciba Geigy Corporation under the trade designation "IRGACURE 651".

A curing agent included in the make coat formulation to promote polymerization of the epoxy resin of the hot melt make coat preferably also is photoactive; that is, the curing agent is preferably a photocatalyst activated by actinic radiation (radiation having a wavelength in the ultraviolet or visible portion of the electromagnetic spectrum). Useful cationic photocatalysts generate an acid to catalyze the polymerization of an epoxy resin. It should be understood that the term "acid" can include either protic or Lewis acids. These cationic photocatalysts can include a metallocene salt having an onium cation and a halogen containing complex anion of a metal or metalloid. Other useful cationic photocatalysts include a metallocene salt having an organometallic complex cation and a halogen containing complex anion of a metal or metalloid which are further described in U.S. Pat. No. 4,751,138 (e.g., column 6, line 65 to column 9, line 45), which is incorporated herein by reference. Another example is an organometallic salt and an onium salt described in U.S. Pat. No. 4,985,340 (col. 4, line 65 to col. 14, line 50); European Patent Applications 306,161; 306,162, all incorporated herein by reference. Still other cationic photocatalysts include an ionic salt of an organometallic complex in which the metal is selected from the elements of Periodic Group IVB, VB, VIB, VIIB and VIIIB which is described in European Patent Application 109,581, which is also incorporated herein by reference.

The cationic catalyst, as a curing agent for the epoxy resin, preferably is included in an amount ranging from about 0.1 to 3% based on the combined weight of the epoxy resin, polyfunctional acrylate component, and the polyester component, i.e., the resinous components. Increasing amounts of the catalyst results in an accelerated curing rate but requires that the hot melt make coat be applied in a thinner layer so as to avoid curing only at the surface. Increased amounts of catalyst can also result in reduced energy exposure requirements and a shortened pot life at application temperatures. The amount of the catalyst is determined by the rate at which the make coat should cure, the intensity of the energy source, and the thickness of the make coat. The same guidelines apply to selection of the amount of the initiator added for curing the polyfunctional acrylate component.

Although the preferred curing agent for epoxy resins is a cationic photocatalyst, certain latent curatives may be utilized, such as the well-known latent curative dicyandiamide.

Where the catalytic photoinitiator used for curing the epoxy resin is a metallocene salt catalyst, it preferably is accompanied by an accelerator such as an oxalate ester of a tertiary alcohol as described in U.S. Pat. No. 5,436,063 (Follett et al.), although this is optional. Oxalate co-catalysts that can be used include those described in U.S. Pat. No. 5,252,694 (Willett). The accelerator preferably comprises from about 0.1 to 4% of the make coat based on the combined weight of the epoxy resin, polyfunctional acrylate component, and the polyester component.

Optionally, the hot melt make coats of the invention may further comprise a hydroxyl-containing material. The hydroxyl-containing material may be any liquid or solid organic material having hydroxyl functionality of at least 1, preferably at least 2. The hydroxyl-containing organic material should be free of other "active hydrogen" containing groups such as amino and mercapto moieties. The hydroxyl-containing organic material should also preferably be devoid of groups which may be thermally or photochemically unstable so that the material will not decompose or liberate volatile components at temperatures below about 100° C. or when exposed to the energy source during curing. Preferably the organic material contains two or more primary or secondary aliphatic hydroxyl groups (i.e., the hydroxyl group is bonded directly to a non-aromatic carbon atom). The hydroxyl group may be terminally situated, or may be pendant from a polymer or copolymer. The number average equivalent weight of the hydroxyl-containing material is preferably about 31 to 2250, more preferably about 80 to 1000, and most preferably about 80 to 350. More preferably, polyoxyalkylene glycols and triols are used as the hydroxyl-containing material. Most preferably, cyclohexane dimethanol is used as the hydroxyl-containing material.

Representative examples of suitable organic materials having a hydroxyl functionality of 1 include alkanols, monoalkyl ethers of polyoxyalkylene glycols, and monoalkyl ethers of alkylene glycols.

Representative examples of useful monomeric polyhydroxy organic materials include alkylene glycols (e.g., 1,2-ethanediol, 1,3-propanediol, 1,4-butanediol, 2-ethyl-1,6-hexanediol, 1,4-cyclohexane dimethanol, 1,18-dihydroxyoctadecane, and 3-chloro-1,2-propanediol), polyhydroxyalkanes (e.g., glycerine, trimethylolethane, pentaerythritol, and sorbitol) and other polyhydroxy compounds such as N,N-bis(hydroxyethyl)benzamide, butane-1,4-diol, castor oil, and the like.

Representative examples of useful polymeric hydroxyl-containing materials include polyoxyalkylene polyols (e.g., polyoxyethylene and polyoxypropylene glycols and triols of equivalent weight of 31 to 2250 for the diols or 80 to 350 for triols), polytetra-methylene oxide glycols of varying molecular weight, hydroxylterminated polyesters, and hydroxyl-terminated polylactones.

Useful commercially available hydroxyl-containing materials include the polytetramethylene oxide glycols available from QO Chemicals, Inc. under the trade designation series "POLYMEG, such as "POLYMEG 650," "POLYMEG 1000" and "POLYMEG 2000"; the polytetramethylene oxide glycols from E. I. duPont de Nemours and Company under the trade designation series "TERATHANE", such as "TERATHANE 650," "TERATHANE 1000" and "TERATHANE 2000"; a polytetramethylene oxide glycol from BASF Corp. under the trade designation "POLYTHF"; the polyvinylacetal resins available from Monsanto Chemical Company under the trade designation series "BUTVAR", such as "BUTVAR B-72A," "BUTVAR B-73," "BUTVAR B-76," "BUTVAR B-90" and "BUTVAR B-98"; the polycaprolactone polyols available from Union Carbide under the trade designation series "TONE", such as "TONE 0200," "TONE 0210," "TONE 0230," "TONE 0240," and "TONE 0260"; the saturated polyester polyols available from Miles Inc. under the trade designation series "DESMOPHEN", such as "DESMOPHEN 2000," "DESMOPHEN 2500," "DESMOPHEN 2501," "DESMOPHEN 2001KS," "DESMOPHEN 2502," "DESMOPHEN 2505," "DESMOPHEN 1700," "DESMOPHEN 1800," and "DESMOPHEN 2504"; the saturated polyester polyols available from Ruco Corp. under the trade designation series "RUCOFLEX", such as "RUCOFLEX S-107," "RUCOFLEX S- 109," "RUCOFLEX S-1011" and "RUCOFLEX S-1014"; a trimethylol propane from Dow Chemical Company under the trade designation "VORANOL 234-630"; a glycerol polypropylene oxide adduct from Dow Chemical Company under the trade designation "VORANOL 230-238"; the polyoxyalkylated bisphenol A's from Milliken Chemical under the trade designation series "SYNFAC", such as "SYNFAC 8009," "SYNFAC 773240," "SYNFAC 8024," "SYNFAC 8027," "SYNFAC 8026," and "SYNFAC 8031"; and the polyoxypropylene polyols from Arco Chemical Co. under the trade designation series "ARCOL series", such as "ARCOL 425," "ARCOL 1025," "ARCOL 2025," "ARCOL 42," "ARCOL 112," "ARCOL 168," and "ARCOL 240".

The amount of hydroxyl-containing organic material used in the make coats of the invention may vary over a broad range, depending on factors such as the compatibility of the hydroxyl-containing material with both the epoxy resin and the polyester component, the equivalent weight and functionality of the hydroxyl-containing material, and the physical properties desired in the final cured make coat.

The optional hydroxyl-containing material is particularly useful in tailoring the glass transition temperature and flexibility of the hot melt make coats of the invention. As the equivalent weight of the hydroxyl-containing material increases, the flexibility of the hot melt make coat correspondingly increases although there may be a consequent loss in cohesive strength. Similarly, decreasing equivalent weight may result in a loss of flexibility with a consequent increase in cohesive strength. Thus, the equivalent weight of the hydroxyl-containing material is selected so as to balance these two properties.

As explained more fully hereinbelow, the incorporation of polyether polyols into the hot melt make coats of the invention is especially desirable for adjusting the rate at which the make coats cure upon exposure to energy. Useful polyether polyols (i.e., polyoxyalkylene polyols) for adjusting the rate of cure include polyoxyethylene and polyoxypropylene glycols and triols having an equivalent weight of about 31 to 2250 for the diols and about 80 to 350 for the triols, as well as polytetramethylene oxide glycols of varying molecular weight and polyoxyalkylated bisphenol A's.

The relative amount of the optional hydroxyl-containing organic material is determined with reference to the ratio of the number of hydroxyl groups to the number of epoxy groups in the hot melt make coat. That ratio may range from 0:1 to 1:1, more preferably from about 0.4:1 to 0.8:1. Larger amounts of the hydroxyl-containing material increase the flexibility of the hot melt make coat but with a consequent loss of cohesive strength. If the hydroxyl containing material is a polyether polyol, increasing amounts will further slow the curing process.

To improve the tack, a tackifier may be incorporated into the make coat formulation. This tackifier may be a rosin ester, an aromatic resin, or mixtures thereof or any other suitable tackifier. Representative examples of rosin ester tackifiers which are useful in the present invention include glycerol rosin ester, pentaerythritol rosin ester, and hydrogenated versions of the above. Representative examples of aromatic resin tackifiers include alphamethyl styrene resin, styrene monomer, polystyrene, coumarone, indene, and vinyl toluene. Preferably, the tackifier is a hydrogenated rosin ester.

Useful tackifier resin types include rosin and rosin derivatives obtained from pine trees and organic acids of abietic and pimaric type which can be esterified, hydrogenated or polymerized (MW. to 2,000), and is commercially available from Hercules Chemical under the trade designation "FORALS" or from Arizona Chemical Co. as "SYLVATAC"; terpene resins obtained from turpentine and citrus peels as alpha & beta-pinene or limonene which can be cationically polymerized(MW. 300 to 2,000) or can be modified with C-9 monomers(terpene phenolic), and is commercially available from Hercules Chemical under trade designation "PICCOLYTE" or from Arizona Chemical Co. under the trade designation "ZONATAC"; or certain aliphatic hydrocarbon resins such as aliphatic resins based on C-5 monomers (e.g., piperylene and dicyclopentadiene) commercially available from Goodyear Chemicals under the trade designation "WINGTACK"; aromatic resins based on C-9 monomers (e.g., indene or styrene) commercially available from Hercules Chemical under the trade designation "REGALREZ" or commercially available from Exxon Chemical under the trade designation "ESCOREZ 2000", which can be hydrogenated (MW 300–1200).

If a tackifier is used in the first binder precursor, it may be present in an amount of 0.1 to 40 parts by weight, preferably 0.5 to 20 parts by weight, based on the total weight of the first binder precursor.

Size coat 20 is applied over abrasive particles 16 and make coat 18. The size coat may comprise a glue or a cured resinous adhesive. Examples of suitable resinous adhesives include phenolic, aminoplast resins having pendant alpha, beta-unsaturated groups, urethane, acrylated urethane, epoxy, acrylated epoxy, isocyanurate, acrylated isocyanurate, ethylenically unsaturated, urea-formaldehyde, melamine formaldehyde, bis-maleimide and fluorene-modified epoxy resins as well as mixtures thereof Precursors for the size coat may further include catalysts and/or curing agents to initiate and/or accelerate the curing process described hereinbelow. The size coat is selected based on the desired characteristics of the finished coated abrasive article.

Both the make and size coats may additionally comprise various optional additives such as fillers, grinding aids, fibers, lubricants, wetting agents, surfactants, pigments, antifoaming agents, dyes, coupling agents, plasticizers and suspending agents so long as they do not adversely affect the pressure sensitive adhesive properties of the make coat (before it fully cures) or detrimentally effect the ability of the make or size coats to cure upon exposure to energy. Additionally, the incorporation of these additives, and the amount of these additives should not adversely affect the rheology of the binder precursors. For example, the addition of too much filler can adversely affect processability of the make coat.

Fillers of this invention must not interfere with the adequate curing of the resin system in which it is contained. Examples of useful fillers for this invention include silica such as quartz, glass beads, glass bubbles and glass fibers; silicates such as talc, clays, (montmorillonite) feldspar, mica, calcium silicate, calcium metasilicate, sodium aluminosilicate, sodium silicate; metal sulfates such as calcium sulfate, barium sulfate, sodium sulfate, aluminum sodium sulfate, aluminum sulfate; gypsum; vermiculite; wood flour; aluminum trihydrate; carbon black; aluminum oxide; titanium dioxide; cryolite; chiolite; and metal sulfites such as calcium sulfite. Preferred fillers are feldspar and quartz.

It has been found in some instances, that the addition of cryolite, chiolite or combinations of cryolite and chiolite to the make coat can result in improved product performance. For example, the make coat precursor may comprise, per 100 parts by weight, between 70 to 99 parts by weight, preferably 80 to 99 parts of the combined blend of epoxy resin, polyester component and polyfunctional acrylate component, and between 1 to 50, preferably 1 to 30 parts by weight of the cryolite/chiolite blend. The cryolite or chiolite may be naturally occurring or synthetically made. An example of a synthetically made cryolite or chiolite is further disclosed in WO 06/08542, incorporated herein by reference.

If a grinding aid is employed in the practice of the present invention, suitable grinding aids include cryolite, chiolite, ammonium cryolite, potassium tetrafluoroborate, and the like.

Abrasive layer 14 may further comprise a third binder or supersize coating 22. One type of useful supersize coating includes a grinding aid, such as potassium tetrafluoroborate, and an adhesive, such as an epoxy resin. This type of supersize coating is further described in European Pat. Publ. No. 486,308, which is incorporated herein by reference. Supersize coating 22 may be included to prevent or reduce the accumulation of swarf (the material abraded from a workpiece) between abrasive particles which can dramatically reduce the cutting ability of the abrasive article. Materials useful in preventing swarf accumulation include metal salts of fatty acids (e.g., zinc stearate or calcium stearate), salts of phosphate esters (e.g., potassium behenyl phosphate), phosphate esters, urea-formaldehyde resins, waxes, mineral oils, crosslinked silanes, crosslinked silicones, fluorochemicals and combinations thereof.

An optional back size coating 24, such as an antislip layer, comprising a resinous adhesive having filler particles dispersed therein can be provided. Alternatively, the backsize coating may be a pressure sensitive adhesive for bonding the coated abrasive article to a support pad may be provided on backing 12. Examples of suitable pressure sensitive adhesives include latex, crepe, rosin, acrylate polymers (e.g., polybutyl acrylate and polyacrylate esters), acrylate copolymers (e.g., isooctylacrylate/ acrylic acid), vinyl ethers (e.g., polyvinyl n-butyl ether), alkyd adhesives, rubber adhesives (e.g., natural rubbers, synthetic rubbers and chlorinated rubbers), and mixtures thereof. An example of a pressure sensitive adhesive coating is described in U.S. Pat. No. 5,520,957, incorporated herein by reference.

The back size coating may also contain an electrically conductive material such as vanadium pentoxide (in, for example, a sulfonated polyester), or carbon black or graphite in a binder. Examples of useful conductive back size coatings are disclosed in U.S. Pat. No. 5,108,463 and U.S. Pat. No. 5,137,452, both of which are incorporated herein by reference.

In order to promote the adhesion of make coat 18 and/or back size coating 24 (if included), it may be necessary to modify the surface to which these layers are applied. For example, if a polymeric film is used as the backing, it may be preferred to modify the surface of, i.e., "prime", the film. Appropriate surface modifications include corona discharge, ultraviolet light exposure, electron beam exposure, flame discharge and scuffing.

The following section will describe exemplary means on how to make the abrasive articles of the invention, especially with respect to manners of forming the abrasive surface thereof.

The hot melt make coat may be prepared by mixing the various ingredients in a suitable vessel at an elevated temperature sufficient to liquify the materials so that they may be efficiently mixed with stirring but without thermally degrading them until the components are thoroughly melt blended. This temperature depends in part upon the particular chemistry. For example, this temperature may range from about 30° to 150° C., typically 50° to 130° C., and preferably ranges from 60° to 120° C. The components may be added simultaneously or sequentially, although it is preferred to first blend the solid epoxy resin and the polyester component followed by the addition of the polyfunctional acrylate, liquid epoxy resin and any hydroxyl-containing material. Then, the photoinitiator and photocatalyst are added followed by any optional additives including fillers or grinding aids.

The hot melt make coat should be compatible in the uncured, melt phase. That is, there should preferably be no visible gross phase separation among the components before curing is initiated. The make coat may be used directly after melt blending or may be packaged in pails, drums or other suitable containers, preferably in the absence of light, until ready for use. The make coats so packaged may be delivered to a hot-melt applicator system with the use of pail unloaders and the like. Alternatively, the hot melt make coats of the invention may be delivered to conventional bulk hot melt applicator and dispenser systems in the form of sticks, pellets, slugs, blocks, pillows or billets. It is also feasible to incorporate organic solvent into the make coat precursor; although this may not always be preferred.

It is also possible to provide the hot melt make coats of the invention as uncured, unsupported rolls of tacky, pressure sensitive adhesive film. In this instance, the make coat precursor is extruded, cast, or coated to form the film. Such films are useful in laminating the make coat to an abrasive article backing. It is desirable to roll up the tacky film with a release liner (for example, silicone-coated Kraft paper), with subsequent packaging in a bag or other container that is not transparent to actinic radiation.

The hot melt make coats of the invention may be applied to the abrasive article backing by extrusion, gravure printing, coating, (e.g., by using a coating die, a heated knife blade coater, a roll coater, a curtain coater, or a reverse roll coater), or lamination. When applying by any of these methods, it is preferred that the make coat be applied at a temperature of about 50° to 125° C., more preferably from about 80° to 125° C.

The hot melt make coats can be supplied as free standing, unsupported pressure sensitive adhesive films that can be laminated to the backing and, if necessary, die cut to a predefined shape before lamination. Lamination temperatures and pressures are selected so as to minimize both degradation of the backing and bleed through of the make coat and may range from room temperature to about 120° C. and about 30 to 250 psi (2.1 to 17.8 kg/cm$^2$). A typical profile is to laminate at room temperature and 100 psi (7.0 kg/cm$^2$). Lamination is a particularly preferred application method for use with highly porous backings.

It is also within the scope of this invention to coat the make coat precursor as a liquid, as from a solvent, although this method is not always preferred. A liquid make coat precursor can be applied to the backing by any conventional technique such as roll coating, spray coating, die coating, knife coating, and the like. After coating the resulting make coat, it may be exposed to an energy source to activate the catalyst before the abrasive grains are embedded into the make coat. Alternatively, the abrasive grains may be coated immediately after the make coat precursor is coated before partial cure is effected.

The coating weight of the hot melt make coat precursor of the invention to a backing can vary depending on the grade of the abrasive particles to be used. For instance, finer grade abrasive particles will generally require less make coat to bond the abrasive particles to the backing. Sufficient amounts of make coat precursor must be provided to satisfactorily bond the abrasive particles. However, if the amount of make coat precursor applied is too great, the abrasive particles may become partially or totally submerged in the make coating, which is undesirable. The make coat precursors of the invention, however, because of the polyfunctional acrylate, are less susceptible to variations in the weight of the make coat than are unmodified epoxy/polyester hot melts. In general, the application rate of the make coat binder precursor composition of this invention (on a solvent free basis) is between about 4 to 300 g/m$^2$, preferably between about 20 to about 30 g/m$^2$.

Preferably, the hot melt make coat is applied to the abrasive article backing by any of the methods described above, and once so applied is exposed to an energy source to initiate at least partial cure of the epoxy resin. The epoxy resin and the epoxy moiety of a compound having both epoxy and acrylate functionality, if present, is thought to cure or crosslink with itself, the optional hydroxyl-containing material, and perhaps to some degree with the polyester component. On the other hand, the polyfunctional acrylate and the acrylate moiety of a compound having both epoxy and acrylate functionality, if present, crosslinks (separately) with itself Curing of the hot melt make coat begins upon exposure of the make coat to an appropriate energy source and continues for a period of time thereafter. The energy source is selected for the desired processing conditions and to appropriately activate the epoxy curative. The energy may be actinic (e.g., radiation having a wavelength in the ultraviolet or visible region of the spectrum), accelerated particles (e.g., electron beam radiation), or thermal (e.g., heat or infrared radiation).

Preferably, the energy is actinic radiation (i.e., radiation having a wavelength in the ultraviolet or visible spectral regions). Suitable sources of actinic radiation include mercury, xenon, carbon arc, tungsten filament lamps, sunlight, and so forth. Ultraviolet radiation, especially from a medium pressure mercury arc lamp, is most preferred. Exposure times may be from less than about 1 second to 10 minutes or more (to preferably provide a total energy exposure from about 0.1 to about 10 Joule/square centimeter (J/cm$^2$)) depending upon both the amount and the type of reactants involved, the energy source, web speed, the distance from the energy source, and the thickness of the make coat to be cured.

The make coats may also be cured by exposure to electron beam radiation. The dosage necessary is generally from less than 1 megarad to 100 megarads or more. The rate of curing my tend to increase with increasing amounts of photocatalyst and/or photoinitiator at a given energy exposure or by use of electron beam energy with no photoinitiator. The rate of curing also tend to increase with increased energy intensity.

Those hot melt make coats which may include a polyether polyol that retards the curing rate are particularly desirable because the delayed cure enables the make coat to retain its pressure sensitive properties for a time sufficient to permit abrasive particles to be adhered thereto after the make coat has been exposed to the energy source. The abrasive particles may be applied until the make coat has sufficiently cured that the particles will no longer adhere, although to increase the speed of a commercial manufacturing operation, it is desirable to apply the abrasive particles as soon as possible, typically within a few seconds of the make coat having been exposed to the energy source. The abrasive particles can be applied by drop coating, electrostatic coating, or magnetic coating according to conventional techniques in the field. Thus, it will be recognized that the polyether polyol can provide the hot melt make coats with an open time. That is, for a period of time (the open time) after the make coat has been exposed to the energy source, it remains sufficiently tacky and uncured for the abrasive particles to be adhered thereto. The abrasive particles are projected into the make coat by any suitable method, preferably by electrostatic coating.

The time to reach full cure may be accelerated by post curing of the make coat with heat, such as in an oven. Post curing can also affect the physical properties of the make coat and is generally desirable. The time and temperature of the post cure will vary depending upon the glass transition temperature of the polyester component, the concentration of the initiator, the energy exposure conditions, and the like. Post cure conditions can range from less than a few seconds at a temperature of about 150° C. to longer times at lower temperatures. Typical post cure conditions are about one minute or less at a temperature of about 100° C.

In an alternative manufacturing approach, the make coat is applied to the backing and the abrasive particles are then projected into the make coat followed by exposure of the make coat to an energy source.

Size coat 20 may be subsequently applied over the abrasive particles and the make coat as a flowable liquid by a variety of techniques such as roll coating, spray coating, gravure coating, or curtain coating and can be subsequently cured by drying, heating, or with electron beam or ultraviolet light radiation. The particular curing approach may vary depending on the chemistry of the size coat. Optional supersize coating 22 may be applied and cured or dried in a similar manner.

Optional back size coating 24 may be applied to backing 12 using any of a variety of conventional coating techniques such as dip coating, roll coating, spraying, Meyer bar, doctor blade, curtain coating, gravure printing, thermomass transfer, flexographic printing, screen printing, and the like.

In an alternate backing arrangement, the back side of the abrasive article may contain a loop substrate. The purpose of the loop substrate is to provide a means that the abrasive article can be securely engaged with hooks from a support pad. The loop substrate may be laminated to the coated abrasive backing by any conventional means. The loop substrate may be laminated prior to the application of the make coat precursor or alternatively, the loop substrate may be laminated after the application of the make coat precursor. In another aspect, the loop substrate may in essence be the coated abrasive backing. The loop substrate will generally comprise a planar surface with the loops projecting from the back side of the front side of the planar surface. The make coat precursor is coated on this planar surface. In this aspect, the make coat precursor is directly coated onto the planar surface of the loop substrate. In some instances, the loop substrate may contain a presize coating over the planar surface which seals the loop substrate. This presize coating may be a thermosetting polymer or a thermoplastic polymer. Alternatively, the make coat precursor may be directly coated onto the non-looped side of an unsealed loop substrate. The loop substrate may be a chenille stitched loop, an extruded bonded loop, a stitchbonded loop substrate or a brushed loop substrate (e.g., brushed polyester or nylon). Examples of typical loop backings are further described in U.S. Pat. Nos. 4,609,581 and 5,254,194, both of which are incorporated herein by reference. The loop substrate may also contain a sealing coat over the planar surface to seal the loop substrate and prevent the make coat precursor from penetrating into the loop substrate. Additionally, the loop substrate may comprise a thermoplastic sealing coat and projecting from the thermoplastic sealing are a plurality of corrugated fibers. This plurality of corrugated fibers actually forms a sheet of fibers. It is preferred that these fibers have arcuate portions projecting in the same direction from spaced anchor portions. In some instances, it is preferred to coat directly onto the planar surface of the loop substrate to avoid the cost associated with a conventional backing. The hot melt make coat precursor can be formulated and coated such that the make coat precursor does not significantly penetrate into the loop substrate. This results in a sufficient amount of make coat precursor to securely bond the abrasive particles to the loop substrate.

Likewise, the back side of the abrasive article may contain a plurality of hooks; these hooks are typically in the form of sheet like substrate having a plurality of hooks protruding from the back side of the substrate. These hooks will then provide the means of engagement between the coated abrasive article and a support pad that contains a loop fabric. This hooked substrate may be laminated to the coated abrasive backing by any conventional means. The hooked substrate may be laminated prior to the application of the make coat precursor or alternatively, the hooked substrate may be laminated after the application of the make coat precursor. In another aspect, the hooked substrate may in essence be the coated abrasive backing. In this scenario, the make coat precursor is directly coated onto the hooked substrate. In some instances, it is preferred to coat directly onto a hooked substrate to avoid the cost associated with a conventional backing. Additional details on the use of hooked backings or lamination of hooks can be found in U.S. Pat. No. 5,505,747 (Chesley et al.), incorporated herein by reference.

Figure 2:
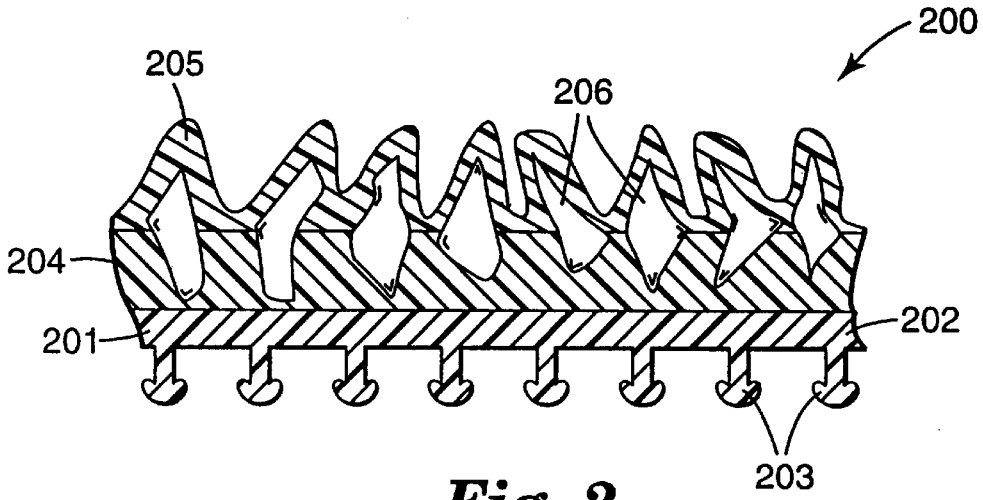
FIG. 2 is a sectional view of an abrasive article according to another embodiment of the invention including a hooked substrate having plurality of releasable hooking stems projecting therefrom.
Figure 3A:
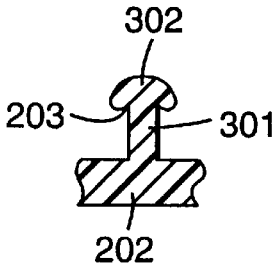
FIGS. 3*a* and 3*b* are sectional views of several embodiments of hooking stems useful in the hooked substrate of the abrasive article illustrated by FIG. 2.
Figure 3B:
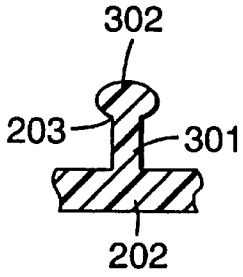

By way of illustration, reference is made to FIG. 2, wherein coated abrasive article 200 comprises a backing 201 which is actually a hooked substrate. This hooked backing substrate 201 comprises generally planar member 202 and plurality of hooking stems 203, each of which includes hooking means to releasably hook engaging structures of an opposed surface. As seen in FIGS. 3*a* and 3*b*, each of the hooking stems 203 have elongate stalks 301 affixed at one end to planar member 202 and with the opposite distal end of stem 203 terminating in a head 302. The particular head structures illustrated in FIGS. 3*a* and 3*b* are exemplary only, as the term "head" means any structure that extends radically beyond the periphery of the stalk 301 in at least one direction. It is also within the scope of this invention that the hooking stems can be replaced with stalks; these stalks do not have a "head" portion associated with them.

Referring now to FIG. 2 again, over the front surface of the hooked substrate is make coat 204 and at least partially embedded into the first binder or make coat 204 is a plurality of abrasive particles 206. Over the abrasive particles and first binder is the second binder or size coat 205. It is preferred that the hooked substrate 201 be made from a thermoplastic material. Examples of such thermoplastic materials include polyamides, polyesters, polyolefins (including polypropylene and polyethylene), polyurethanes, polyimides and the like. Further details on the hooking stems 203, such as hook materials, hook structures, hook dimensions, modes of affixing the hooking stems to the planar member, are described in U.S. Pat. No. 5,505,747 (Chesley et al.), which is incorporated herein by reference.

Figure 4:
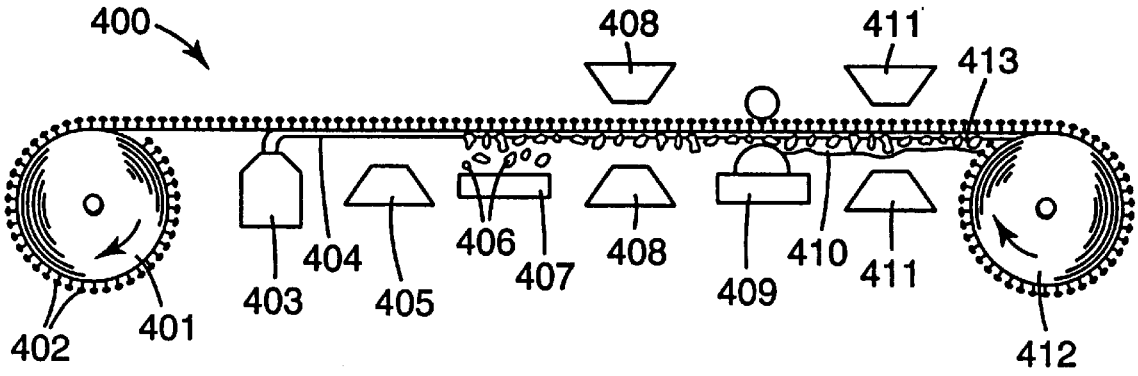
FIG. 4 is a schematic illustration of an apparatus and process for combining an abrasive article with a hooked substrate as illustrated in FIG. 2.

FIG. 4 illustrates one embodiment of an apparatus and process for making an abrasive article of the invention including a hooked substrate. The process 400 starts with a roll of hooked substrate 401, such as one previously formed by a process as exemplified in FIG. 5 and described below, being unwound at station 401. This hooked substrate has a plurality of hooking stems 402. Next, first binder precursor 404 is applied by coater 403 to the outer surface of hooked substrate 401. This outer surface is generally opposite to the hooking stems 402. The first binder precursor 404 can be applied by any convenient coating technique, such as an extruder, die coater, roll coater, and the like. Alternatively, the first binder precursor may be transfer coated to the outer surface of hooked substrate 401. Next, first binder precursor 404 is exposed to first energy source 405 to initiate the partial polymerization of first binder precursor 404 and/or activate a catalyst. Typically the first energy source 405 is an ultraviolet light, and/or visible light. Following this, abrasive grains 406 are at least partially embedded into make coat precursor 404 by means of an abrasive grain coater 407. This abrasive grain coater is typically an electrostatic coater. The resulting construction is then exposed to second energy source 408 to help further advance the polymerization of first binder precursor 404. Then, second binder precursor or size coat precursor 410 is applied by means of size coater 409 over the abrasive particles 406. Immediately following this, the resulting construction is exposed to third energy source 411 to assist in the polymerization of the size coat precursor 410. Third energy source 411 can be thermal (heat), E-beam, UV light, visible, or a combination of UV and thermal energy. After this curing step, the resulting coated abrasive 413 is wound upon a roll 412 and it is ready for subsequent conventional finishing steps.

Figure 5:
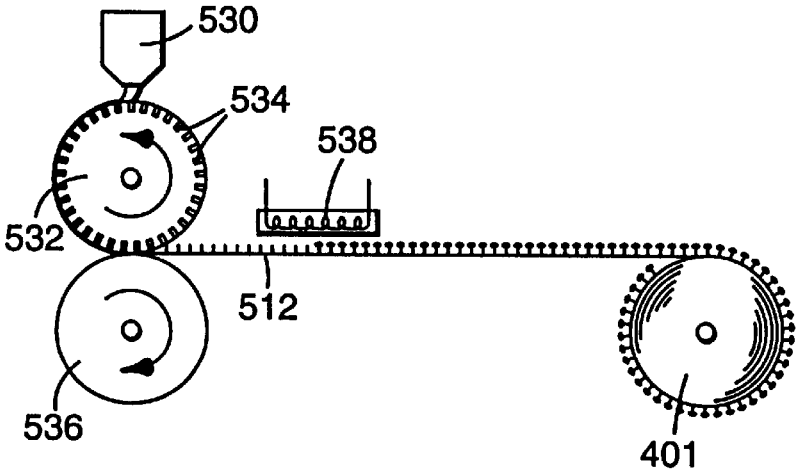
FIG. 5 is schematic illustration of an apparatus and a method for making the hooked substrate component of the abrasive article illustrated in FIG. 2.

FIG. 5 illustrates an exemplary technique for making a hooked substrate 401 (201) that can be used as a starting material for the process of making the abrasive article as shown in FIG. 4. The process includes an extruder 530 adapted for extruding a flowable material, such as thermoplastic resin, into a mold 532. The surface of the mold includes a plurality of arranged cavities 534, which are adapted to form a like plurality of stems from the flowable material. The cavities 534 may be arranged, sized, and shaped as required to form a suitable stem structure from the flowable material. Typically, a sufficient additional quantity of flowable material is extruded onto mold 532 to form base sheet 512 concurrently. Mold 532 is rotatable and forms a nip, along with opposed roll 536. The nip between mold 532 and opposed roll 536 assists in forcing the flowable material into cavities of the mold, and provides a uniform base sheet 512. The temperature at which the foregoing process is carried out depends on the particular material used. For example, the temperature is in the range of 230° to 290° C. for a random copolymer of polypropylene available from Shell Oil Company of Houston, Tex., under the trade designation "WRS6-165".

The mold may be of the type used for either continuous processing (such as tape, a cylinder drum, or a belt), or batch processing (such as injection mold), although the former is preferred. The cavities of the mold may be formed in any suitable manner, such as by drilling, machining, laser machining, water jet machining, casting, die punching, or diamond turning. The mold cavities should be designed to facilitate release of the stems therefrom, and thus may include angled side walls, or a release coating, e.g., a release coating of polytetra-fluoroethylene (such as a coating available from E. I. DuPont DeNemours under the trade designation "Teflon"), on the cavity walls. The mold surface may also include a release coating thereon to facilitate release of the base sheet from the mold.

The mold can be made from suitable materials that are rigid or flexible. The mold components can be made of metal, steel, ceramic, polymeric materials (including both thermosetting and thermoplastic polymers) or combinations thereof The materials forming the mold must have sufficient integrity and durability to withstand the thermal energy associated with the particular molten metal or thermoplastic material used to form the base sheet and hooking stems. In addition, the material forming the mold preferably allows for the cavities to be formed by various methods, is inexpensive, has a long service life, consistently produces material of acceptable quality, and allows for variations in processing parameters.

In the illustrated embodiment of FIG. 5, the stems projecting from the base sheet are not provided with hooking stems (e.g., heads adjoining the stems, or an included distal end angle of less than approximately 90 degrees) at the time the base sheet leaves the mold 532. Hooking means are provided in the illustrated embodiment of FIG. 5, in the form of a head adjoining each stem, by heating the stems with a heated plate 538 to thereby deform the distal end of the stem, but may also be provided by contacting the distal ends of the stems with a heated calendering roller to form the heads. Other heating means are contemplated, including but not limited to convective heating by hot air, radiative heating by heat lamp or heated wire, and conductive heating by heated roll or plate.

It is also within the scope of this invention to print indicia over the surface of the hooking stems. For example, the appropriate abrasive grain information (e.g., grade number), product description, product identification number, bar coding and other such description may be printed over the surface of the hooking stems by any conventional means. After the hook substrate is made, this hook substrate can be laminated to the back side of the coated abrasive article. Alternatively, the make coat precursor can be coated directly onto the opposite smooth side of this hooked substrate.

The make coats of the invention provide a balance of highly desirable properties. As solvent free formulations, they are easily applied using conventional hot melt dispensing systems. Consequently, they can be supplied as pressure sensitive adhesive films well suited for lamination to a backing. The inclusion of a polyester component provides the make coats with pressure sensitive properties which facilitates the application of the abrasive particles thereto. The provision of a polyether polyol of appropriate molecular weight and functionality provides the make coats of the invention with an open time subsequent to energy exposure that permits the abrasive particles to be projected into the make coat after it has been exposed to energy. The incorporation of the polyfunctional acrylate component in the make coat provides superior rheology control beyond that which is afforded with hot melt epoxy/polyester component systems lacking the polyfunctional acrylate binder modifier. More specifically, the hot melt make coat formulations used in the present invention have a lower viscosity prior to irradiation and a higher viscosity subsequent to irradiation than the mere combinations of epoxy and polyester devoid of the polyfunctional acrylate component. As a result, the hot melt materials used in the make coat of the present invention are less sensitive to coating thickness than conventional photocurable hot melt resin systems. Moreover, these processing advantages are realized without compromising the desirable thermomechanical properties of the epoxy/polyester systems. That is, the hot melt composition cures to yield a tough, durable aggressively bonded crosslinked, thermoset make coat.

The invention will be more fully understood with reference to the following nonlimiting examples in which all parts, percentages, ratios, and so forth, are by weight unless otherwise indicated.

Abbreviations used in the examples have the definitions shown in the following schedule.

| | |
|---|---|
| DS1227 | a high molecular weight polyester under the trade designation "DYNAPOL S1227" commercially available from Huls America, Piscataway, NJ. |
| DS1402 | a high molecular weight polyester with low crystallinity under the trade designation "DYNAPOL S1402" commercially available from Huls America, Piscataway, NJ. |
| EP1 | a bisphenol A epoxy resin under the trade designation "EPON 828" (epoxy equivalent wt. of 185–192 g/eq) commercially available from Shell Chemical, Houston, TX. |
| EP2 | a bisphenol A epoxy resin under the trade designation "EPON 1001F" (epoxy equivalent wt. of 525–550 g/eq) commercially available from Shell Chemical, Houston, TX. |
| CHDM | cyclohexanedimethanol |
| HS | backing of made according to U.S. Pat. No. 5,505,747 with hooking stem as shown in FIG. 2 herein and similar to hooking stem illustrated in FIG.'s 2c and 2d of U.S. Pat. No. 5,505,747. |
| TMPTA | trimethylol propane triacrylate commercially available from Sartomer Co., Exton, PA under the trade designation "SR351". |
| Et-TMPTA | ethoxylated trimethylol propane triacrylate commercially available from Sartomer Co., Exton, PA under the trade designation "SR454". |
| PETA | pentaerythritol tetraacrylate commercially available from Sartomer Co., Exton, PA under the trade designation "SR295". |
| NPGDA | neopentylglycol diacrylate commercially available from Sartomer Co., Exton, PA under the trade designation "SR247". |
| Abitol E | tackifier commercially available from Hercules Inc., Wilmington, DE. |
| "KB1" | 2,2-dimethoxy-1,2-diphenyl-1-ethanone commercially available from Ciba-Geigy under the trade designation "IRGACURE 651" or commercially available from Sartomer Co., Exton, PA under the trade.designation "KB1" per se. |
| COM | eta$^6$-[xylenes (mixed isomers)]eta$^5$-cyclopentadienyl-iron(1+) hexafluoroantimonate (1−) (acts as a catalyst). |
| AMOX | di-t-amyloxalate (acts as an accelerator). |
| FLDSP | feldspar |
| CRY | cryolite |
| BAO | brown fused aluminum oxide |
| HTAO | heat treated fused aluminum oxide |

TEST PROCEDURES

The Examples and Comparative Examples described below were tested according to some or each of the following test procedures.

TEST #1

Schiefer Test Procedure

The coated abrasive article for each example was converted into a 10.2 cm diameter disc and secured to a foam back-up pad by means of a pressure sensitive adhesive. The coated abrasive disc and back-up pad assembly was installed on a Schiefer testing machine, and the coated abrasive disc was used to abrade a cellulose acetate butyrate polymer. The load was 4.5 kg. The endpoint of the test was 500 revolutions or cycles of the coated abrasive disc. The amount of cellulose acetate butyrate polymer removed and the surface finish (Ra and Rtm) of the cellulose acetate butyrate polymer were measured at the end of the test. Ra is the arithmetic average of the scratch size in micrometers. Rtm was measured as the mean of the maximum peak to valley height as measured in micrometers. Ra and Rtm were measured with a Mahr Perthometer profilometer.

TEST #2

DA Sanding Test/Off-Hand Abrasion Test

A steel substrate coated with an e-coat, primer, base coat, and clear coat typically used in automotive paints was abraded in each case with 15.2 cm. diameter coated abrasive discs made in accordance with the examples which were attached to a random orbital sander (available under the trade designation "DAQ" from National Detroit, Inc.). The steel substrates were purchased from ACT Company of Hillsdale, Mich., and were subsequently coated with a PPG primer available under the trade designation "KONDAR, Acrylic Primer DZ-3". The cut in grams was computed in each case by weighing the paint-coated substrate before abrading and after abrading for a predetermined time, for example, 1 or 3 minutes.

Example A

Coated abrasive articles A1–A6 each used a backing that was a 115 g/m$^2$ paper backing commercially available from Kammerer, Germany. A make coat precursor for each of examples A1 to A6 was prepared from DS1227 (20.7 parts), EP1 (30.5 parts), EP2 (33.7 parts), CHDM (2.9 parts), Abitol E(7.0 parts), COM (0.6 part), "KB1" (1.0 part) and AMOX (0.6 parts). The batch was prepared by melting DS1227 and EP-2 together at 140° C., mixing, then adding EP-1, CHDM, and Abitol E and mixing at 100° C. Then, TMPTA, in the amounts indicated in Table 1, was added with mixing at 100° C. To this sample was added COM, AMOX, and KB 1 followed by mixing at 100° C. The make coat precursor was applied at 125° C. by means of a knife coater to the paper backing at a weight of about 100 g/m$^2$.

It was observed that that the formulations containing 5% and 10% TMPTA, i.e., examples A2, A3, A5 and A6, were lower in viscosity at the coating temperature than the unmodified formulations in A1 and A4, and, as a result, were somewhat easier to coat onto the backing.

It was also noticed that the formulations for A2, A3, A5 and A6 were tackier at room temperature (with increasing tack with increasing proportion of TMPTA).

The sample was then irradiated (3 passes at 18.3 m/min) with two 118 W/cm "H" bulbs) either immediately before or after grade P180 BAO was electrostatically projected into the make coat precursor at a weight of about 115 g/m$^2$. Table 1 indicates the sequence applied to each example.

The intermediate product was thermally cured for 15 minutes at a temperature of 100° C. Then, a size coat precursor was roll coated over the abrasive grains at a wet weight of about 50 g/m$^2$. The size coat precursor consisted of a 100% solids blend of a UV curable resin consisting of one part Et-TMPTA and two parts of a mixture of liquid epoxy resins. After the curing step, the sample was supersized with a standard calcium stearate coating at a weight of about 25 g/m$^2$.

The mineral pick-up achieved and cut determined by TEST #1 for each example, A1–A6, are summarized in Table 1.

TABLE 1

| Ex. | % TMPT A | Time of Irradiation | Mineral Pickup (g/m$^2$) | Cut (grams) after 500 cycles |
|---|---|---|---|---|
| A1 | 0 | before mineral applied | 101 | 0.088 |
| A2 | 5 | before mineral applied | 104 | 2.860 |
| A3 | 10 | before mineral applied | 22 | 2.055 |
| A4 | 0 | after mineral applied | 128 | 0.013 |
| A5 | 5 | after mineral | 128 | 2.803 |

TABLE 1-continued

| Ex. | % TMPTA | Time of Irradiation | Mineral Pickup ($g/m^2$) | Cut (grams) after 500 cycles |
|---|---|---|---|---|
| A6 | 10 | applied after mineral applied | 38 | 1.828 |

The results summarized in Table I show that performance was similar when irradiating before or after mineral (grade P180 BAO) is coated. With no TMPTA added, mineral pickup was excellent but it was also observed to be located beneath the surface of the resin, and cut was negligible. With 5% TMPTA, both mineral pickup and Schiefer cut were excellent. With 10% TMPTA, mineral pickup was noticeably less, but cut was still improved over the Comparative Examples A1 and A4 having no TMPTA.

EXAMPLES 1–8

The coated abrasive article of the following Examples 1–8 and Comparative Examples 1–4 were prepared according to the same procedure of Example A except with any differences in formulation as indicated in Table 2 and any other departures as pointed out in the synopses provided below for the examples.

TABLE 2

| Components Parts by Wt. | EX. 1 & 8 | EX. 2 & 4 | EX. 3 | EX. 5 | EX. 6 | EX. 7 |
|---|---|---|---|---|---|---|
| DS-1227 | 21.58 | | 22.5 | 15.75 | 15.75 | 23.17 |
| DS-1402 | | 39.76 | | | | |
| Ep-1 | 31.82 | 26.84 | 33.18 | 23.23 | 23.23 | 34.17 |
| EP-2 | 35.18 | 29.82 | 36.68 | 25.68 | 25.68 | 37.78 |
| CHDM | 2.98 | 2.39 | 3.11 | 2.17 | 2.17 | 3.2 |
| TMPTA | | 3 | 3 | 3 | 3 | |
| COM | 0.6 | 0.6 | 0.6 | 0.6 | 0.6 | 0.6 |
| "KB1" | 1 | 1 | 1 | 1 | 1 | 1 |
| t-AMYL OX. | 0.6 | 0.6 | 0.6 | 0.6 | 0.6 | 0.6 |
| Abitol E | 7.27 | | | | | |
| FLDSP | | | | 30 | | |
| CRY | | | | | 30 | |

Example 1

The hot melt resin was transfer coated onto a corona-treated flat side of a HS backing having a PET nonwoven incorporated into it. The make weight was 25 $g/m^2$, and it was activated using a doped mercury arc from Fusion Systems ("D" bulb) at 79 watts/cm at 9.1 m/min and coated with grade P180 BAO at 125 $g/m^2$. The make cure conditions were 20 seconds at 90° C. The material was sized with a size coat precursor consisting of a 100% solids blend of a UV-curable resin consisting of one part Et-TMPTA and two parts of a mixture of liquid epoxy resins to 38 $g/m^2$ and cured using 2 "H"0 bulbs at 79 watts/cm, 3 passes at 15 m/min and then given a thermal cure for 30 min. at 100° C. It was then coated with a standard calcium stearate supersize coating formulation to 33 $g/m^2$ and air dried.

Example 2

The hot melt resin was transfer coated onto a corona-treated flat side of a HS backing as described in Example 1. The make weight was 27 $g/m^2$, and it was activated using a Fusion "V" bulb at 79 watts/cm and coated with grade P180 HTAO at 71 $g/m^2$ at a web speed of 15 m/min. The make cure conditions were 10 minutes at 99° C. The material was sized with a size coat precursor consisting of a 100% solids blend of a UV-curable resin consisting of one part Et-TMPTA and two parts of a mixture of liquid epoxy resins to 33 $g/m^2$ and cured using 2 "H" bulbs at 79 watts/cm, 3 passes at 18 m/min and then given a thermal cure for 30 min. at 100° C. It was then coated with a calcium stearate supersize coating (viz., a water-based calcium stearate solution with 50% solids content) to 17 $g/m^2$ and dried for 10 minutes at 100° C.

Example 3

The hot melt resin was transfer coated onto a corona-treated flat side of a HS backing as in Example 1. The make weight was 27 $g/m^2$, and it was activated using a Fusion "V" bulb at 79 watts/cm and coated with grade P180 HTAO at 71 $g/m^2$. The make cure conditions were 10 minutes at 99° C. The material was sized with a size coat precursor consisting of a 100% solids blend of a UV-curable resin consisting of one part Et-TMPTA and two parts of a mixture of liquid epoxy resins to 33 $g/m^2$ and cured using 2 "H" bulbs at 79 watts/cm, 3 passes at 18 m/min and then given a thermal cure for 30 min. at 100° C. It was then coated with a calcium stearate supersize coating as in Example 2 to 17 $g/m^2$and dried for 10 minutes at 100° C.

Example 4

The hot melt resin was directly coated onto a corona-treated polypropylene film. The make weight was 27 $g/m^2$, and it was activated using a Fusion "V" bulb at 79 watts/cm and coated with grade P180 HTAO at 84 $g/m^2$ at a web speed of 15 m/min. The make cure conditions were 10 minutes at 99° C. The material was sized with a size coat precursor consisting of a 100% solids blend of a UV-curable resin consisting of one part Et-TMPTA and two parts of a mixture of liquid epoxy resins to 33 $g/m^2$ and cured using 2 "H" bulbs at 79 watts/cm, 3 passes at 18 m/min and then given a thermal cure for 30 min. at 100° C. It was then coated with a calcium stearate supersize coating as in Example 2 to 17 $g/m^2$ and dried for 10 minutes at 100° C.

Example 5

The hot melt resin was directly coated onto a paper backing (150 $g/m^2$, obtained under the trade designation "Eddy Sandback N206"). The make weight was 21 $g/m^2$, and it was activated using a Fusion "V" bulb at 79 watts/cm and coated with grade P180 HTAO at 71 $g/m^2$ at a web speed of 15 m/min. The make cure conditions were 10 minutes at 99° C. The material was sized with a size coat precursor consisting of a 100% solids blend of a UV-curable resin consisting of one part Et-TMPTA and two parts of a mixture of liquid epoxy resins to 33 $g/m^2$ and cured using 2 "H" bulbs at 79 watts/cm, 3 passes at 18 m/min and then given a thermal cure for 30 min. at 100° C. It was then coated with a calcium stearate supersize coating as in Example 2 to 17 $g/m^2$ and dried for 10 minutes at 100° C.

Example 6

The hot melt resin was transfer coated onto a corona-treated flat side of a HS backing as in Example 1. The make weight was 28 $g/m^2$, and it was activated using a Fusion "V" bulb at 79 watts/cm and coated with grade P180 HTAO at 75 $g/m^2$ at a web speed of 15 m/min. The make cure conditions were 10 minutes at 99° C. The material was sized with a size coat precursor consisting of a 100% solids blend of a UV-curable resin consisting of one part Et-TMPTA and two parts of a mixture of liquid epoxy resins to 33 g/m$^2$ and cured using 2 "H" bulbs at 79 watts/cm, 3 passes at 18 m/min and then given a thermal cure for 30 min. at 100° C. It was then coated with a calcium stearate supersize coating as in Example 2 to 17 g/m$^2$ and dried for 10 minutes at 100° C.

Example 7

The hot melt resin was transfer coated onto a Brushed PET backing supplied by Guilford. The make weight was 84 g/m$^2$, and it was activated using a Fusion "D" bulb at 79 watts/cm and coated with grade P180 BAO at 75 g/m$^2$ at a web speed of 9 m/min. The make cure conditions were 10 minutes at 99° C. The material was sized with a urea-formaldehyde size resin to 75 g/m$^2$ and cured for 30 minutes at 70° C. It was then coated with a calcium stearate supersize coating as in Example 2 to 17 g/m$^2$ and dried for 10 minutes at 100° C.

Example 8

The hot melt resin was transfer coated onto a corona-treated flat side of a HS backing as in Example 1. The make weight was 22 g/m$^2$, and it was activated using a Fusion "V" bulb at 79 watts/cm and coated with grade P180 BAO at 71 g/m$^2$ at a web speed of 15 m/min. The make cure conditions were 10 minutes at 99° C. The material was sized with a size coat precursor consisting of a 100% solids blend of a UV-curable resin consisting of one part Et-TMPTA and two parts of a mixture of liquid epoxy resins to 33 g/m$^2$ and cured using 2 "H" bulbs at 79 watts/cm, 3 passes at 18 m/min and then given a thermal cure for 30 min. at 100° C. It was then coated with a calcium stearate supersize coating as in Example 2 to 17 g/m$^2$ and dried for 10 minutes at 100° C.

Comparative Examples 1–4

The following Comparative Examples 1–4, designated CE1–CE4, respectively, were prepared:

CE1: A Grade P180 coated abrasive "A" wt. disc, which is commercially available from the Minnesota Mining & Manufacturing Co., Saint Paul, Minn. under the trade designation "216U".

CE2: A Grade P180 disc abrasive 2 mil film commercially available from Minnesota Mining & Manufacturing Co., Saint Paul, Minn. under the trade designation "255L Production HOOKIT".

CE3: A Grade P180 coated abrasive "B" wt. disc commercially available from Minnesota Mining & Manufacturing Co., Saint Paul, Minn. under the trade designation "255P HOOKIT".

CE4: A Grade 180-A coated abrasive disc having a "B" wt paper backing and commercially available from Norton Company under the trade designation "NO-FIL Adalox Speed-Grip A273".

The coated abrasive articles prepared from Examples 1–8 and Comparative Examples 1–4 were then analyzed according to the tests indicated in Table 3 with the noted exceptions where tests were not conducted. The results are summarized in Table 3.

TABLE 3

| EXAMPLE | TEST #1 (g) | Ra (μm) | Rtm (μm) | TEST #2 (1 min) | TEST #2 (3 min) |
|---|---|---|---|---|---|
| 1 | 3.10 | 2.1 | 12.0 | 4.08 | 10.6 |
| 2 | 3.62 | 2.5 | 17.2 | 4.71 | 13.05 |
| 3 | 3.60 | 2.5 | 17.0 | 4.89 | 13.52 |
| 4 | 3.46 | 2.2 | 14.7 | 5.15 | 14.63 |
| 5 | 3.36 | 2.4 | 16.1 | 5.49 | 15.96 |
| 6 | 3.12 | 2.4 | 16.0 | 5.34 | 15.55 |
| 7 | 2.21 | 1.9 | 12.3 | * | * |
| 8 | 2.90 | 2.1 | 13.9 | 3.08 | 8.17 |
| CE1 | 3.12 | 2.4 | 16.0 | 4.90 | 14.23 |
| CE2 | 2.83 | 1.8 | 10.9 | 4.71 | 13.35 |
| CE3 | 3.10 | 1.7 | 10.3 | 4.71 | 13.36 |
| CE4 | 3.38 | 1.9 | 11.7 | 4.47 | 12.85 |

*No test conducted

EXAMPLES 9–14

Additional coated abrasives were prepared according to the same procedure described for Example A except with the formulations changed to those indicated in Table 4. The six formulations for Examples 9–14 cover a variety of hot melt systems varying the polyfunctional acelate, the type of polyester, and the presence of a tackifier. The effective concentration range of the polyfunctional acrylate is proportional to the equivalent weight of the polyfunctional acrylate and inversely proportional to the fuctionality of the polyfunctional acrylate.

TABLE 4

| Components Parts by Wt. | EX. 9 | EX. 10 | EX. 11 | EX. 12 | EX. 13 | EX. 14 |
|---|---|---|---|---|---|---|
| DS-1227 | 20.7 | 20.1 | 20.8 | 19.9 | | |
| DS-1402 | | | | | 37.5 | 54.3 |
| EP-1 | 30.5 | 29.6 | 30.6 | 29.4 | 28.2 | 20.1 |
| EP-2 | 33.7 | 32.8 | 33.9 | 32.5 | 25.3 | 18.1 |
| CHDM | 2.9 | 2.8 | 2.9 | 2.8 | 2.3 | 2.3 |
| TMPTA | 3.0 | | | | 4.5 | 3.0 |
| Et-TMPTA | | 5.8 | | | | |
| PETA | | | 2.7 | | | |
| NPGDA | | | | 6.4 | | |
| COM | 0.6 | 0.6 | 0.6 | 0.6 | 0.6 | 0.6 |
| KB1 | 1.0 | 1.0 | 1.0 | 1.0 | 1.0 | 1.0 |
| t-AMYL OX. | 0.6 | 0.6 | 0.6 | 0.6 | 0.6 | 0.6 |
| Abitol E | 7.0 | 6.8 | 7.0 | 6.7 | | |
| Total parts | 100.0 | 100.0 | 100.0 | 100.0 | 100.0 | 100.0 |

The coated abrasive articles prepared from each of Examples 9–14 were then evaluated for mineral pickup and cut according to TEST #1 (after 500 cycles). The results are reported in Table 5.

TABLE 5

| EXAMPLE # | mineral pickup (g/m$^2$) | TEST #1 (g) |
|---|---|---|
| 9 | 86.9 | * |
| 10 | 129.2 | 2.60 |
| 11 | 93.2 | 2.67 |
| 12 | 102.8 | * |
| 13 | 123.7 | 2.67 |
| 14 | 122.5 | 3.00 |

*No test conducted

Various modifications and alterations of this invention will become apparent to those skilled in the art without departing from the scope and spirit of this invention, and it should be understood that this invention is not to be unduly limited to the illustrated embodiment set forth herein.

What is claimed is:

1. A treated cloth material comprising:

a cloth material treated with a energy-curable, melt-processable composition comprising:

a) an epoxy resin, b) a polyfunctional acrylate component, c) a polyester component, and d) a curing agent for crosslinking the epoxy resin.

2. The treated cloth material of claim 1, wherein the composition comprises per 100 parts by weight:

a) about 5 to 75 parts of the epoxy resin;

b) about 5 to 94 parts of the polyester component;

c) about 0.1 to 20 parts of the polyfunctional acrylate component;

d) about 0.1 to 4 parts of the epoxy curing agent; and e) an optional hydroxyl-containing material having functionality of at least 1.

3. A treated backing comprising:

a backing treated with an energy-curable melt-processable composition comprising:

a) an epoxy resin, b) a polyfunctional acrylate component, c) a polyester component, and d) a curing agent for crosslinking the epoxy resin.

4. The treated backing according to claim 3, wherein the backing is selected from group consisting of cloth; vulcanized fiber; paper; nonwoven materials; fibrous reinforced thermoplastic material; substrates containing hooked stems, looped fabrics, metal foils, and mesh; polymeric film; foam materials; laminated materials; and multilayer combinations thereof.

5. The treated backing according to claim 3, wherein the backing includes paper material.

6. The treated backing according to claim 3, wherein the backing includes a nonwoven material.

7. The treated backing according to claim 3, wherein the backing includes a polymeric material.

8. The treated backing according to claim 3, wherein the backing includes a fibrous reinforced thermoplastic material.

9. The treated backing according to claim 3, wherein the backing includes a vulcanized fiber material.

10. The treated backing according to claim 3, wherein the energy-curable melt-processable composition is at least partially cured.

11. A method of treating a cloth material, comprising the steps of:

(a) applying an energy-curable melt-processable composition to a surface of a porous cloth material, the composition comprising:

i) an epoxy resin, ii) a polyfunctional acrylate component, iii) a polyester component, iv) a curing agent for crosslinking said epoxy resin; and (b) exposing the composition to an energy producing source to crosslink the composition to form a surface-treated cloth material.

12. The surface-treated cloth material product of the method of claim 11.

13. The method of treating a cloth material according to claim 11, wherein the porous cloth material has a Gurley porosity of less than 50 seconds.

14. The method of treating a cloth material according to claim 11, wherein the energy-curable melt processable composition is a solvent free system.

15. The method of treating a cloth material according to claim 11, wherein the epoxy resin comprises a glycidyl ether monomer of the formula:

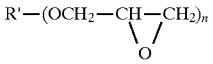

where R' is alkyl or aryl and n is an interger of 1 to 6.

16. The method of treating a cloth material according to claim 11, wherein the polyfunctional acrylate component is selected from the group consisting of ethylene glycol diacrylate, ethylene glycol dimethacrylate, hexanediol diacrylate, triethylene glycol diacrylate, trimethylolpropane triacrylate, ethoxylated trimethylolpropane triacrylate, glycerol triacrylate, pentaerthyitol triacrylate, pentaerythritol trimethacrylate, pentaerythritol tetraacrylate, pentaerythritol tetramethacrylate, neopentylglycol diacrylate, and combinations thereof.

17. The method of treating a cloth according to claim 11, wherein the curing agent for crosslinking said epoxy resin is a photocatalyst.

18. The method oftreating a cloth material according to claim 17, wherein the photocatalyst is a cationic photocatalyst capable of generating an acid to catalyze polymerization of the epoxy resin.

19. The method of treating a cloth material according to claim 11, wherein the energy producing source is selected from the group consisting of actinic radiation, electron beam radiation, thermal radiation, and combinations thereof.

20. The method of treating a cloth material according to claim 11, wherein the radiation is selected from the group consisting of ultraviolet energy producing source visible radiation, and combinations thereof.

21. A method of treating a backing, comprising the steps of:

a) applying an energy-curable melt-processing composition to a surface of a backing, the composition comprising:

i) an epoxy resin, ii) a polyfunctional acrylate component, iii) a polyester component, and iv) a curing agent for crosslinking the epoxy resin; and b) exposing the composition to an energy producing source to crosslink the composition to form a treated backing.

* * * * *

UNITED STATES PATENT AND TRADEMARK OFFICE

CERTIFICATE OF CORRECTION

PATENT NO. : 5,863,847
DATED : January 26, 1999
INVENTOR(S) : Robert J. DeVoe, Gregg D. Dahlke, Kimberly K. Harmon and Craig A. Masmar It is certified that error appears in the above-identified patent and that said Letters Patent is hereby corrected as shown below:

Column 2,
Line 60, Theological" should read --rheological--

Column 5,
Line 16, "thereof" should read --thereof.--
Line 47, "thereof" should read --thereof.--

Column 13,
Line 36, "hydroxylterminated" should read --hydroxyl-terminated--

Column 15,
Line 27, "thereof" should read thereof.--

Column 25,
Line 56, ""H"0 should read --"H"--

Column 30,
Line 42, "radiation" should be replaced with --energy producing source--
Line 43, "energy producing source" should be replaced with --radiation--

Signed and Sealed this

Twenty first Day of July, 2001

*Attest:*

Nicholas P. Godici

*Attesting Officer*

NICHOLAS P. GODICI
*Acting Director of the United States Patent and Trademark Office*